US010483682B1

(12) United States Patent
Yu

(10) Patent No.: US 10,483,682 B1
(45) Date of Patent: Nov. 19, 2019

(54) ANTI-ABRASION CONNECTOR

(71) Applicant: AMPHENOL EAST ASIA ELECTRONIC TECHNOLOGY (SHEN ZHEN) CO., LTD., Shenzhen, Guangdong Province (CN)

(72) Inventor: Yue Yu, Shenzhen (CN)

(73) Assignee: AMPHENOL EAST ASIA ELECTRONIC TECHNOLOGY (SHEN ZHEN) CO., LTD., Shen Zhen, Guangdong Province (CN)

( * ) Notice: Subject to any disclaimer, the term of this patent is extended or adjusted under 35 U.S.C. 154(b) by 0 days.

(21) Appl. No.: 16/259,272

(22) Filed: Jan. 28, 2019

(51) Int. Cl.

| | |
|---|---|
| ***H01R 13/502*** | (2006.01) |
| ***H01R 13/506*** | (2006.01) |
| ***H01R 13/629*** | (2006.01) |
| ***H01R 12/71*** | (2011.01) |
| ***H01R 13/516*** | (2006.01) |
| ***H01R 13/639*** | (2006.01) |

(52) U.S. Cl.
CPC ..... *H01R 13/506* (2013.01); *H01R 12/712* (2013.01); *H01R 13/516* (2013.01); *H01R 13/629* (2013.01); *H01R 13/639* (2013.01)

(58) Field of Classification Search
CPC .. H01R 13/506; H01R 13/516; H01R 13/629; H01R 13/639; H01R 12/712
See application file for complete search history.

(56) References Cited

U.S. PATENT DOCUMENTS

| | | | | |
|---|---|---|---|---|
| 2007/0202753 | A1* | 8/2007 | Murakami | H01R 4/185 439/701 |
| 2010/0203772 | A1* | 8/2010 | Mao | H01R 13/502 439/701 |
| 2017/0222346 | A1* | 8/2017 | Kobayashi | H01R 12/91 |

* cited by examiner

*Primary Examiner* — Xuong M Chung Trans
(74) *Attorney, Agent, or Firm* — Muncy, Geissler, Olds & Lowe, P.C.

(57) ABSTRACT

An anti-abrasion connector includes a casing and a main body; the casing having a tube structure mounted around the main body; the main body having a terminal cavity for the terminal to be inserted therein; the casing having at least two protection members; the protection members disposed on an inner side of an edge of the casing; each of the protection members having a connection body and a protection body, respectively; the connection body formed in a curve-shaped structure and connected with the corresponding edge of the casing; the protection body formed in a cuboid shape and connected with the casing through the corresponding connection body. When the casing is mounted around the main body, each of the protection bodies covering an inner wall of the main body. With the optimized connector structure, the anti-abrasion capability during plugging of the connector is improved, enhancing stability of connection.

15 Claims, 3 Drawing Sheets

ANTI-ABRASION CONNECTOR

BACKGROUND OF THE INVENTION

1. Field of the Invention

The present invention relates to connectors, and more particularly, to an anti-abrasion connector.

2. Description of the Related Art

Anti-abrasion property is a key technique for a high quality connector. The elements of a connector for executing a plugging or swapping function are easily worn by the abrasion during swapping or plugging of the connector. As a result, the connection stability of the connector is affected. Therefore, the technique for improving the swapping or plugging stability through the enhancement of anti-abrasion function of the connector has been a focus of the industrial development.

SUMMARY OF THE INVENTION

For improving the issues above, an anti-abrasion connector solution is disclosed by the present invention. By improving the connector structure, the anti-abrasion function for swapping and plugging execution of the connector is enhanced.

For achieving the aforementioned objective, an anti-abrasion connector in accordance with an embodiment of the present invention comprises a casing and a main body;

the casing comprising a tube shape structure mounted around the main body;

the main body comprising a terminal cavity for the terminal to be inserted therein;

the casing comprising at least two protection members;

the protection members disposed on an inner side of an edge of the casing; each of the protection members comprising a connection body and a protection body;

the connection body formed in a curve-shaped structure and connected with the edge of the casing;

the protection body formed in a cuboid shape and connected with the casing through the corresponding connection body; and when the casing is mounted around the main body, each of the protection bodies covering an inner wall of the main body.

Preferably, the protection body comprises two side plates disposed on two sides of the protection body, respectively. The protection body having the two side plates has a sectional face formed in a U shape.

Preferably, the protection body comprises two side plates and two neck plates that are both disposed on two sides of the protection body, respectively, wherein the side plate and the neck plate on the same side are connected. The protection body having the two side plates and the two neck plates has a sectional face formed in a U shape.

Preferably, the main body is formed in a rectangular tube shape structure including short side walls and long side walls. When the casing is mounted around the main body, each of the protection body covers an inner side of the corresponding short side wall.

Preferably, the main body is formed in a rectangular tube shape structure including short side walls and long side walls. When the casing is mounted around the main body, each of the protection body covers an inner side of the corresponding short side wall and a part of an inner side of the corresponding long side wall.

Preferably, the casing is formed of metal material.

Preferably, the casing is formed of plastic material.

Preferably, the connection body has a transverse sectional face formed in an arc shape.

With such solution, the present invention achieves following advantages.

Compared with prior arts, the present invention improves the anti-abrasion function of the connector by an optimized connector structure. With the protection members disposed on the inner side of the casing edge, which is the position bearing most of the abrasion during plugging operation with respect to the PCB, the abrasion upon the main body is lowered, thus decreasing the damage upon the stability of the connection.

Furthermore, with the side plates on two sides of the protection members, the protection range is enlarged, thus improving the anti-abrasion function.

Further, with the side plates and the neck plates on two sides of the protection members, the protection range is enlarged, thus improving the anti-abrasion function.

DETAILED DESCRIPTION OF THE INVENTION

Figure 1:
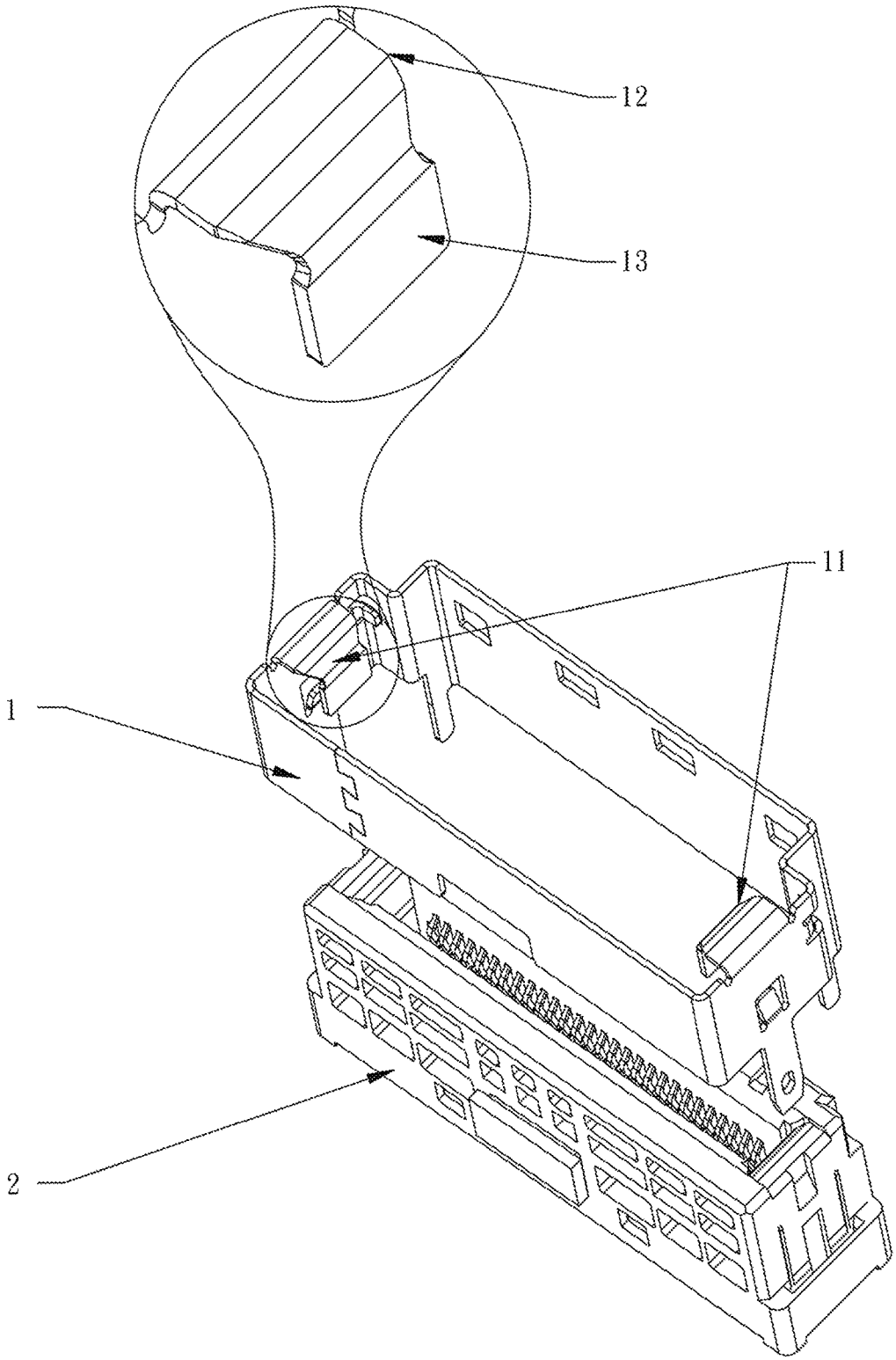
FIG. 1 is an exploded view of the anti-abrasion connector in accordance with an embodiment of the present invention.
Figure 2:
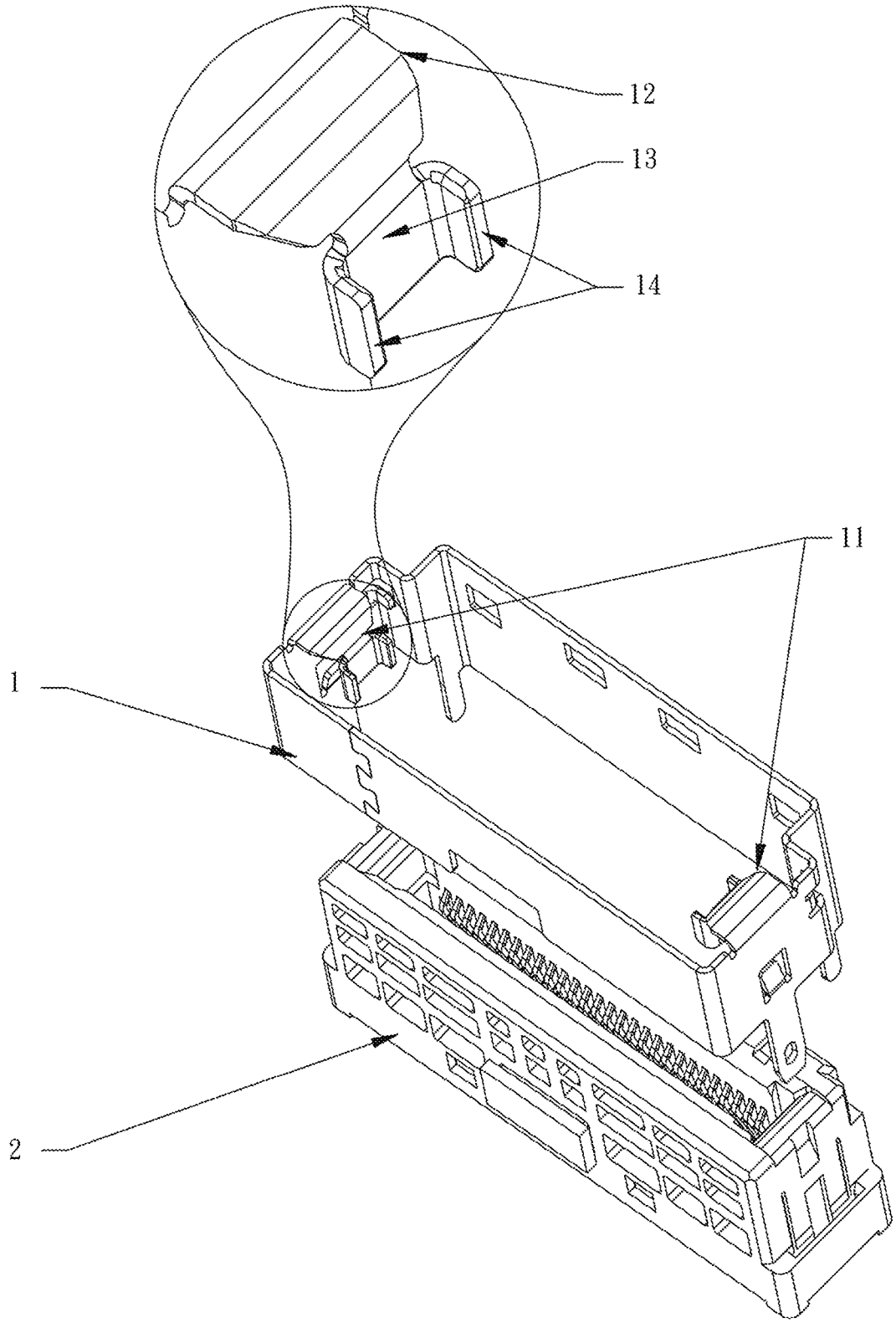
FIG. 2 is an exploded view of the anti-abrasion connector in accordance with another embodiment (including side plates) of the present invention.
Figure 3:
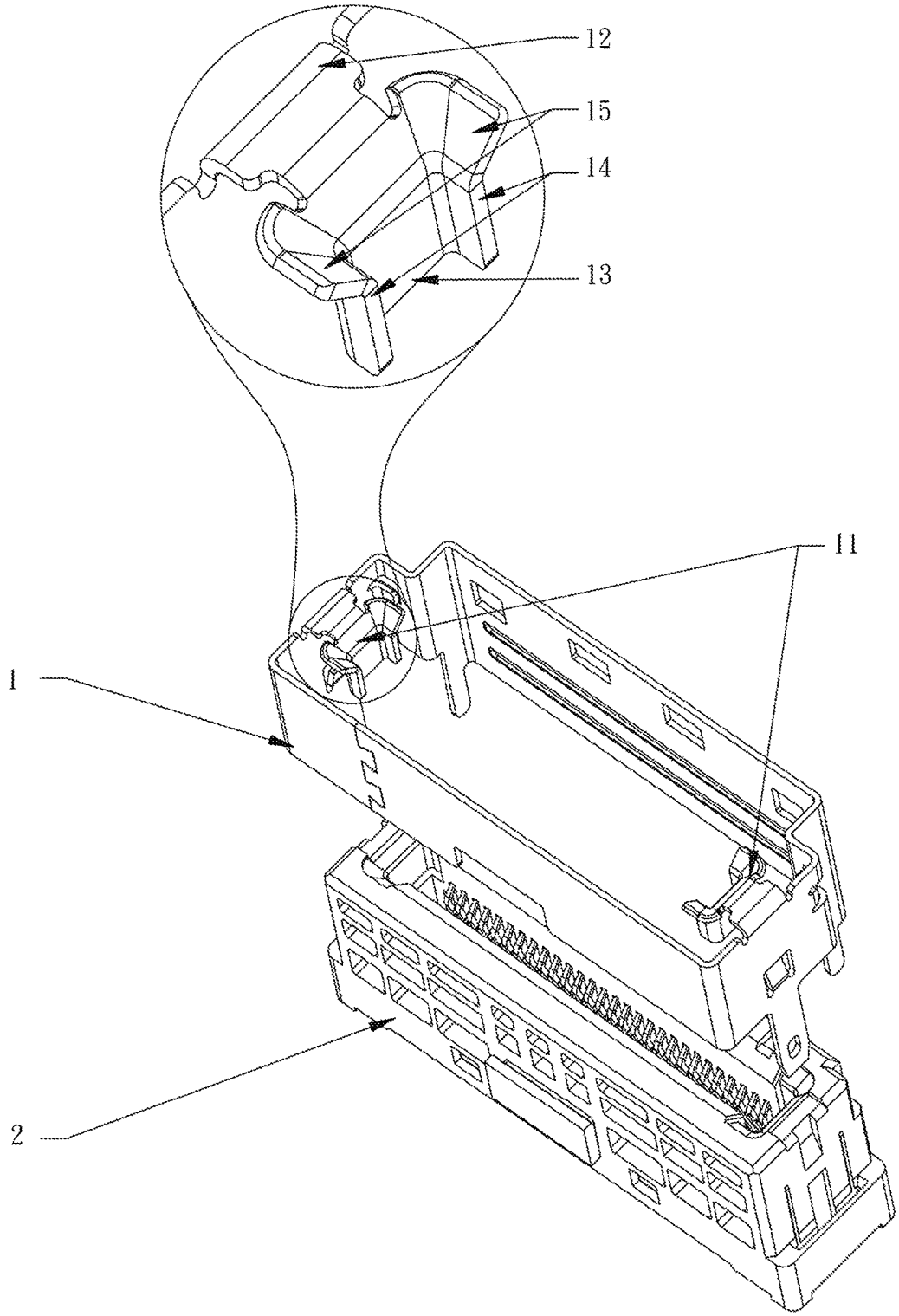
FIG. 3 is an exploded view of the anti-abrasion connector in accordance with another embodiment (including side plates and neck plates) of the present invention.

The aforementioned and further advantages and features of the present invention will be understood by reference to the description of the preferred embodiment in conjunction with the accompanying FIG. 1 to FIG. 3 where the components are illustrated based on a proportion for explanation but not subject to the actual component proportion.

Embodiment 1

Referring to FIG. 1, an anti-abrasion connector in accordance with an embodiment of the present invention comprises a casing 1 and a main body 2;

the casing 1 formed of metal material in a tube shape structure mounted around the main body 2;

the main body 2 formed of plastic material in a rectangular tube shape structure and comprising short side walls and long side walls; the main body 2 comprising a terminal cavity for the terminal to be inserted therein;

the casing 1 comprising two protection members 11;

the protection members 11 disposed on an inner side of an edge of the casing 1; each of the protection members 11 comprising a connection body 12 and a protection body 13;

the connection body 12 formed in a curve-shaped structure having a transverse sectional face formed in an arc shape and connected with the edge of the casing 1;

the protection body 13 formed in a cuboid shape and connected with the casing 1 through the corresponding connection body 12; and when the casing 1 is mounted around the main body 2, each of the protection bodies 13 covers an inner wall of the main body 2.

Embodiment 2

Based on the embodiment 1, referring to FIG. 2, each of the protection bodies 13 comprises two side plate 14; the two side plates 14 disposed on two sides of the corresponding protection body 13, respectively; each of the protection bodies 13 with the two side plates 14 having a sectional face formed in a U shape. When the casing 1 is mounted around the main body 2, each of the protection bodies 13 covers an inner side of the corresponding short side wall of the main body 2.

Embodiment 3

Based on the embodiments above, referring to FIG. 3, each of the protection bodies 13 comprises two side plate 14 and two neck plates 15; the two side plates 14 disposed on two sides of the corresponding protection body 13, respectively; the two neck plates 15 disposed on two sides of the corresponding protection body 13, respectively; the side plate 14 and the neck plate 15 on the same side being connected; each of the protection bodies 13 with the two side plates 14 and the two neck plates 15 having a sectional face formed in a U shape. When the casing 1 is mounted around the main body 2, each of the protection bodies 13 covers an inner side of the corresponding short side wall and a part of an inner side of the corresponding long side wall.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An anti-abrasion connector comprising a casing and a main body;

the casing comprising a tube structure mounted around the main body;

the main body comprising a terminal cavity for the terminal to be inserted therein;

the casing comprising at least two protection members;

the protection members disposed on an inner side of an edge of the casing; each of the protection members comprising a connection body and a protection body, respectively;

the connection body formed in a curve-shaped structure and connected with the corresponding edge of the casing;

the protection body formed in a cuboid shape and connected with the casing through the corresponding connection body; and when the casing is mounted around the main body, each of the protection bodies covering an inner wall of the main body.

2. The connector of claim 1, wherein each protection body comprises two side plates; the two side plates are disposed on two sides of the protection body; and the protection body having the two side plates has a sectional face formed in a U shape.

3. The connector of claim 1, wherein each protection body comprises two side plates and two neck plates; the two side plates are disposed on two sides of the protection body; the two neck plates are disposed on two sides of the protection body; the side plate and the neck plate on the same side of the protection body are connected; and the protection body having the two side plates and the two neck plates has a sectional face formed in a U shape.

4. The connector of claim 1, wherein the main body is formed in a rectangular tube shape structure having short side walls and long side walls; when the casing is mounted around the main body, each of the protection bodies covering an inner side of the corresponding short side wall of the main body.

5. The connector of claim 2, wherein the main body is formed in a rectangular tube shape structure having short side walls and long side walls; when the casing is mounted around the main body, each of the protection bodies covering an inner side of the corresponding short side wall of the main body.

6. The connector of claim 3, wherein the main body is formed in a rectangular tube shape structure having short side walls and long side walls; when the casing is mounted around the main body, each of the protection body covers an inner side of the corresponding short side wall and a part of an inner side of the corresponding long side wall.

7. The connector of claim 1, wherein the casing is formed of metal material.

8. The connector of claim 2, wherein the casing is formed of metal material.

9. The connector of claim 3, wherein the casing is formed of metal material.

10. The connector of claim 1, wherein the main body is formed of plastic material.

11. The connector of claim 2, wherein the main body is formed of plastic material.

12. The connector of claim 3, wherein the main body is formed of plastic material.

13. The connector of claim 1, wherein the connection body has a transverse sectional face formed in an arc shape.

14. The connector of claim 2, wherein the connection body has a transverse sectional face formed in an arc shape.

15. The connector of claim 3, wherein the connection body has a transverse sectional face formed in an arc shape.

* * * * *